United States Patent [19]

Korenko et al.

[11] 4,236,943

[45] Dec. 2, 1980

[54] PRECIPITATION HARDENABLE IRON-NICKEL-CHROMIUM ALLOY HAVING GOOD SWELLING RESISTANCE AND LOW NEUTRON ABSORBENCE

[75] Inventors: Michael K. Korenko, Richland, Wash.; Howard F. Merrick, Suffern, N.Y.; Robert C. Gibson, Ringwood, N.J.

[73] Assignee: The United States of America as represented by the United States Department of Energy, Washington, D.C.

[21] Appl. No.: 917,832

[22] Filed: Jun. 22, 1978

[51] Int. Cl.[2] ..... C22C 19/05

[52] U.S. Cl. ..... 148/32.5; 75/122; 75/134 F; 75/171

[58] Field of Search ..... 75/122, 171, 134 F; 148/32.5

[56] References Cited

U.S. PATENT DOCUMENTS

| | | | |
|---|---|---|---|
| 2,994,605 | 8/1961 | Gill et al. | 75/171 |
| 3,046,108 | 7/1962 | Eiselstein | 75/171 |
| 3,160,500 | 12/1964 | Eiselstein et al. | 75/171 |
| 3,598,578 | 8/1971 | Wang | 75/171 |
| 3,705,827 | 12/1972 | Muzyka et al. | 75/171 |
| 3,865,581 | 2/1975 | Sekino et al. | 75/171 |
| 4,066,447 | 1/1978 | Smith, Jr. et al. | 75/122 |

OTHER PUBLICATIONS

Huntington Alloys, "Inconel Alloy 706", 1974, Int'l. Nickel Co., Inc., pp. 1–13.

Huntington Alloys, "Inconel Alloy 718", 1968, Int'l. Nickel Co., Inc. pp. 1–24.

Cozar et al., "Morphology of Y' and Y" Precipitates and Thermal Stability of Inconel 718 Type Alloys", Metallurgical Transactions, vol. 4, 1/73, pp. 47–59.

*Primary Examiner*—R. Dean

*Attorney, Agent, or Firm*—James E. Denny; Richard G. Besha; C. L. McHale

[57] ABSTRACT

An iron-nickel-chromium age-hardenable alloy suitable for use in fast breeder reactor ducts and cladding which utilizes the gamma-double prime strengthening phase and characterized in having a morphology of the gamma-double prime phase enveloping the gamma-prime phase and delta phase distributed at or near the grain boundaries. The alloy consists essentially of about 40–50% nickel, 7.5–14% chromium, 1.5–4% niobium, 0.25–0.75% silicon, 1–3% titanium, 0.1–0.5% aluminum, 0.02–0.1% carbon, 0.002–0.015% boron, and the balance iron. Up to 2% manganese and up to 0.01% magnesium may be added to inhibit trace element effects; up to 0.1% zirconium may be added to increase radiation swelling resistance; and up to 3% molybdenum may be added to increase strength.

7 Claims, No Drawings

PRECIPITATION HARDENABLE IRON-NICKEL-CHROMIUM ALLOY HAVING GOOD SWELLING RESISTANCE AND LOW NEUTRON ABSORBENCE

GOVERNMENT CONTRACT

This invention was conceived during the performance of work under Contract EY-76-C-14-2170 for the Department of Energy.

BACKGROUND OF THE INVENTION

While not limited thereto, the present invention is particularly adapted for use as a fast breeder reactor duct and fuel rod cladding alloy. Such an alloy requires strong mechanical properties at high temperatures and at the same time must have both swelling resistance under the influence of irradiation and low neutron absorbence. Alloys such as those described in U.S. Pat. No. 3,046,108 to Eiselstein, disclose age-hardenable nickel-chromium base alloys which have high strength and good ductility over a wide temperature range up to about 1400° F. Specifically, the aforesaid patent discloses a nickel-base alloy having a nominal composition consisting essentially of about 53% nickel, about 19% chromium, about 3% molybdenum, about 5% niobium, about 0.2% silicon, about 0.2% manganese, about 0.9% titanium, about 0.45% aluminum, about 0.04% carbon and the balance essentially iron. The alloy is characterized in the age-hardened condition by a yield strength (0.2% offset) of at least 100,000 pounds per square inch at room temperature and by a 100-hour rupture strength of at least 90,000 p.s.i. at 1200° F.

An article by R. Cozar and A. Pineu appearing in "Metallurgical Transactions", Vol. 4, January 1973, page 47, explains that nickel-base alloys containing titanium and aluminum, such as those described in U.S. Pat. No. 3,046,108 are strengthen by precipitation of a gamma-prime phase. It has also been found that by adjusting the amounts of titanium, aluminum and niobium in such alloys, a morphology can be obtained wherein precipitated gamma-prime particles are coated on their six faces with a shell of gamma-double prime precipitate. The resulting microstructure is very stable on prolonged aging and has thermal stability better than that encountered with most alloys described in U.S. Pat. No. 3,046,108.

While the mechanical properties at high temperatures of alloys such as those described above are particularly suitable for use in nuclear applications, they generally contain in excess of 50% nickel and in excess of 5% niobium, both of which act as neutron absorbers which makes them undesirable for breeder reactor applications. It is, therefore, desirable to employ an alloy which has reduced amounts of these alloying additions; but at the same time, it has been found that alloys containing about 37% nickel, for example, will not precipitate the gamma-double prime phase and that the ratio of atomic percent iron-to-nickel must be less than unity to give the requisite mechanical properties. Thus, the known alloys, while having the requisite mechanical properties, are deficient in one or more respects under the influence of irradiation as is encountered, for example, in a fast breeder reactor.

SUMMARY OF THE INVENTION

The present invention resides in the discovery that the nickel and niobium contents can be decreased in an iron-nickel-chromium alloy containing titanium and aluminum to achieve a reduction in neutron absorbence while at the same time retaining the gamma-prime and gamma-double prime phases to achieve high strength mechanical properties at elevated temperatures. The alloy also has good swelling resistance in response to irradiation.

Specifically, it has been found that by reducing the aluminum content of such alloys to about 0.3% and increasing the titanium content to about 1.7%, nickel reduced from about 53% to about 45% and niobium from about 5% to as little as 1.7%, thereby reducing neutron absorbence while retaining swelling resistance under irradiation. In addition, the chromium content can be decreased from about 19% to 12% or lower with no deleterious effects.

The above and other objects and features of the invention will become apparent from the following detailed description of exemplary embodiments of the invention.

DESCRIPTION OF THE PREFERRED EMBODIMENTS

The broad range and preferred compositions of the alloy of the invention are listed in the following Table I:

TABLE I

| | Broad- % | Preferred- % |
|---|---|---|
| Nickel | 40–50 | 43–47 |
| Chromium | 7.5–14 | 8–12 |
| Niobium | 1.5–4 | 3–3.8 |
| Silicon | .25–.75 | .3–.4 |
| Zirconium | 0–.1 | 0–.05 |
| Titanium | 1–3 | 1.5–2 |
| Aluminum | .1–.5 | .2–.3 |
| Carbon | .02–.1 | .02–.05 |
| Boron | .002–.015 | .002–.006 |
| Molybdenum | 0–2 | 0–3 |
| Iron | Bal. | Bal. |

In order to derive the optimized alloy of the invention, a number of alloys were examined, the compositions of these alloys being listed in the following Table II:

TABLE II

| Alloy | Fe | Ni | Cr | Mo | Nb | Hf | Si | Mn | Mg | Zr | Ti | Al | C | B | Identified Precipitat |
|---|---|---|---|---|---|---|---|---|---|---|---|---|---|---|---|
| D31 | Bal | 37 | 12 | — | 2.5 | — | — | — | — | 0.03 | 1.0 | 0.2 | 0.03 | 0.010 | None |
| D32 | Bal | 37 | 12 | — | 4.0 | — | — | — | — | 0.03 | 2.8 | 0.8 | 0.03 | 0.010 | Y', n |
| D33 | Bal | 45 | 12 | — | 4.0 | — | — | — | — | 0.03 | 1.9 | 0.5 | 0.03 | 0.010 | Y', Y'', |
| D66 | Bal | 45 | 12 | 3.0 | — | — | 0.5 | — | — | 0.05 | 2.5 | 2.5 | 0.03 | 0.005 | Y' |
| D31-M-1 | Bal | 37 | 12 | — | 3.0 | 0.03 | 0.5 | — | — | 0.03 | 1.9 | 0.5 | 0.03 | 0.01 | None |
| D31-M-2 | Bal | 37 | 12 | — | 3.0 | 0.03 | 0.5 | — | — | 0.03 | 1.9 | 0.8 | 0.03 | 0.01 | None |
| D31-M-3 | Bal | 37 | 12 | — | 3.0 | 0.03 | 0.5 | — | — | 0.03 | 1.9 | 1.3 | 0.03 | 0.01 | None |
| D31-M-4 | Bal | 37 | 12 | — | 3.0 | 0.03 | 0.5 | — | — | 0.03 | 1.9 | 1.6 | 0.03 | 0.01 | None |
| D31-M-5 | Bal | 37 | 12 | — | 3.0 | 0.03 | 0.5 | — | — | 0.03 | 1.9 | 1.9 | 0.03 | 0.01 | Y' |
| D31-M-6 | Bal | 37 | 12 | — | 3.0 | — | 0.5 | — | — | 0.05 | 2.5 | 2.5 | 0.03 | 0.005 | Y' |
| D31-M-7 | Bal | 37 | 12 | 2.0 | 4.0 | — | 0.5 | — | — | 0.05 | 0.8 | 0.6 | 0.03 | 0.005 | Y' |

TABLE II-continued

| Alloy | Fe | Ni | Cr | Mo | Nb | Hf | Si | Mn | Mg | Zr | Ti | Al | C | B | Identified Precipitat |
|---|---|---|---|---|---|---|---|---|---|---|---|---|---|---|---|
| D31-M-8 | Bal | 37 | 12 | 4.5 | 4.0 | — | 0.5 | — | — | 0.05 | 0.8 | 0.6 | 0.03 | 0.005 | Y' |
| D31-M-9 | Bal | 37 | 15 | 3.0 | 4.0 | — | 0.5 | 0.2 | 0.02 | — | 1.0 | 0.4 | 0.04 | 0.005 | Y' |
| D31-M-10 | Bal | 45 | 12 | — | 4.0 | — | 0.5 | 0.2 | 0.02 | 0.05 | 1.8 | 0.8 | 0.03 | 0.005 | Y', |
| D31-M-11 | Bal | 45 | 12 | — | 4.0 | — | 0.5 | 0.2 | 0.02 | 0.05 | 1.8 | 1.0 | 0.03 | 0.005 | Y', |
| D31-M-12 | Bal | 45 | 12 | — | 4.0 | — | 0.5 | 0.2 | 0.02 | 0.05 | 1.8 | 1.2 | 0.03 | 0.005 | Y', |
| D31-M-13 | Bal | 45 | 12 | 2.0 | 4.0 | — | 0.5 | 0.2 | 0.02 | 0.05 | 1.8 | 0.8 | 0.03 | 0.005 | Y', |
| D31-M-14 | Bal | 45 | 12 | 2.0 | 4.0 | — | 0.5 | 0.2 | 0.02 | 0.05 | 1.8 | 1.0 | 0.03 | 0.005 | Y', |
| D31-M-15 | Bal | 45 | 12 | — | 3.6 | — | 0.5 | 0.2 | 0.02 | 0.05 | 1.7 | 0.3 | 0.03 | 0.005 | ** |
| D31-M-16 | Bal | 37 | 12 | — | 4.0 | — | 1.5 | 0.2 | 0.02 | 0.05 | 2.6 | 0.8 | 0.03 | 0.005 | ** |
| D68 | Bal | 45 | 12 | — | 3.6 | — | 0.35 | 0.2 | 0.01 | 0.05 | 1.7 | 0.3 | 0.03 | 0.005 | |
| D69 | Bal | 37 | 12 | — | 4.0 | — | 0.35 | 0.2 | 0.01 | 0.05 | 2.6 | 0.8 | 0.03 | 0.005 | |

*Excluding carbides.
**Not fabricable.

Alloys aged in the range of 16–24 hours at about 760° C. Alloy D31, upon examination of its photomicrographs, did not contain any precipitates because of the increased solubility of titanium and aluminum in this region of phase space. Likewise, Alloy D32 did not produce the gamma-double prime phase because of its relatively low nickel and high aluminum contents. Alloy D33, containing 45% nickel and 12% chromium contained not only the gamma-prime and gamma-double prime phases but also the undesirable delta phase.

In the alloy series D31-M-1 through D31-M-6, the base composition was set at 37% nickel, 3% niobium, and the balance iron in order to provide a limit on the absorption cross section; and hafnium, silicon and zirconium were added for swelling resistance. The titanium-to-aluminum ratio was varied in the series D31-M-1 through D31-M-6 which would be expected to produce the gamma-prime and gamma-double prime phases in the low aluminum alloys and the gamma-prime phase alone in the high aluminum alloys. Table II shows, however, that alloys D31-M-1 through D31-M-4 did not contain any precipitates at all except carbides. It is believed that this is due to the fact that alloys in this lower chromium, intermediate nickel range of the phase diagram have a very high solubility for titanium and aluminum. Alloys D66 and D31 which contained 5% titanium plus aluminum and no undesirable phases further substantiated this conclusion.

Alloys D31-M-7 to D31-M-9 were then melted with 4% niobium and increasing additions of molybdenum. This was done on the basis that molybdenum would decrease the solubility of the alloy for titanium and aluminum. The presence of the gamma-prime phase in these alloys shows that the anticipated role of molybdenum is correct. These alloys, which have a titanium plus aluminum content of 1.4% produced the gamma-prime phase. On the other hand, it can be seen from Table II that alloy D31-M-4 containing titanium plus aluminum of 3.5% and no molybdenum, does not contain the gamma-prime phase. In Alloy D31-M-9, the chromium content was increased from the 12% level. Increasing chromium works much like molybdenum in reducing the aluminum plus titanium solubilities, but it does not increase the propensity for gamma-double prime formation. That is, even though the titanium-to-aluminum ratios are in the correct range, the gamma-double prime phase will not be observed. For this reason, the iron-to-nickel ratio plays a role in determining the limits of phase stability for gamma-double prime precipitate. That is, the ratio of iron-to-nickel must be less than unity.

As was explained above, it is desirable, for nuclear reactor fuel rod cladding applications, to utilize materials having a low neutron absorbence. Both nickel and niobium have high neutron absorbence characteristics; and while increasing the niobium from the 4% value used in Alloys D31-M-7 through D31-M-9 would shift the material into the gamma-double prime range, niobium is three times as bad as nickel as regards neutron absorbence on a weight percent basis.

Therefore, the only alternative is to increase the nickel content as is the case in Alloys D31-M-10 through D31-M-15 in Table II. To these alloys, manganese and magnesium were added to inhibit trace element embrittlement effects; while silicon was set at 0.5% for swelling resistance. In this series of alloys, the titanium-to-aluminum ratios were varied over what was again considered to be a reasonable range. Phase extraction analysis of these alloys revealed the presence of the gamma-prime and delta phases with no gamma-double prime. Those slloys (i.e., D31-M-13 and 14) containing 2% molybdenum had a greater volume fraction of the undesirable delta phase. A comparison of Alloys D33 and D31-M-10 reveals only relatively minor differences in composition. Primarily, the difference is in the aluminum content, being 0.5% in Alloy D33 which contains the gamma-double prime phase and 0.8% in Alloy D31-M-10 which did not contain the gamma-double prime phase. By lowering the aluminum content to 0.3%, the titanium content to 1.7% and the niobium content to 3.6%, Alloy D68 was derived which has both the gamma-prime and gamma-double prime phases, relatively low neutron absorbence and good swelling resistance. For maximum swelling reistance in D68 type alloys, the silicon content should be maintained near the upper limit of the range, namely 0.75%.

The nominal composition of the alloy of the invention is, therefore, about 45% nickel, about 12% chromium, about 3.6% niobium, about 0.35% silicon, about 1.7% titanium, about 0.3% aluminum, about 0.03% carbon, about 0.005% boron and the remainder iron, with manganese, magnesium and zirconium being optional additions.

From the foregoing Table II, it will be apparent that the molybdenum content is not crucial to the existence of the gamma-double prime phase since alloys containing the gamma-double prime phase with no molybdenum have been produced over the 41.5 to 53.8% nickel range. As the molybdenum content is increased, the solid solution strengthening increment of molybdenum increases and the gamma/gamma prime mismatch is altered. Increasing molybdenum decreases the solubility of titanium and aluminum, which are the most effective solid solution strengtheners. The lost strength from a reduced level of titanium and aluminum in solution is greater than the positive strength increment from molybdenum. Thus, this result, coupled with the results of increasing delta formation with increasing molybdenum and of the high neutron absorption cross section of molybdenum, dictates that molybdenum preferably should be kept as low as possible and under 3%.

The aluminum content is the single most sensitive parameter. Aluminum should be kept as low as possible and no greater than 0.5%, the preferred value being 0.3%. Again, because of its high neutron absorbence, niobium should be kept low, no greater than 4%.

Once the aluminum content is fixed, the relative and absolute values of titanium and niobium are crucial. The titanium plus aluminum-to-niobium ratio of greater than 1 (when expressed in atomic percent) is a necessary condition to produce a gamma-prime/gamma-double prime morphology. Increasing the titanium content promotes the envelope structure. Increasing titanium also reduces swelling, decreases the neutron absorption cross section, and strengthens the alloy by the formation of additional gamma-double prime, by solid solution strengthening of the gamma and gamma-prime phases, and by mismatch effects. When the composition of Alloy D68 is converted to atomic percent, the (Ti+Al)/Nb ratio is 1.1 fulfilling the requirements for the desired morphology.

Alloy D31-M-15 in Table II did not take into account fabricability and, therefore, fractured during hot rolling. The only difference between Alloy D31-M-15 and Alloy D68 which might affect fabricability are the silicon and manganese levels, both of which are lower in Alloy D68. Therefore, silicon preferably should be kept below 0.4% and magnesium at about 0.1%, unless maximum swelling resistance is desired in which event the silicon should be increased to the range between 0.60% and 0.75%.

The alloy of the invention, when aged for 2 hours at 800° C., plus furnace cooling to 625° C. and holding for 12 hours, has a time to rupture of about 280 hours at a testing stress of 621 MPa and a time to rupture of about 2.9 hours at a testing stress of 724 MPa.

Although the invention has been shown in connection with certain specific embodiments, it should be readily apparent to those skilled in the art that various changes in form and arrangement of parts may be made to suit requirements without departing from the spirit and scope of the invention.

What is claimed is:

1. An iron-nickel-chromium age-hardenable alloy characterized in having a compact morphology of the gamma-double prime phase enveloping the gamma-prime phase and consisting essentially of about 40 to 50% nickel, 7.5 to 14% chromium, 1.5 to 4% niobium, 0.25 to 0.75% silicon, 1 to 3% titanium, 0.1 to 0.5% aluminum, 0.02 to 0.1% carbon, 0.002 to 0.015% boron and the balance iron.

2. The alloy of claim 1 in which the ratio of iron-to-nickel is less than one.

3. The alloy of claim 1 wherein the ratio of Ti+Al to Nb, when experessed in atomic percent, is greater than one.

4. The alloy of claim 1 wherein silicon is present in the amount of about 0.75%.

5. An iron-nickel-chromium age-hardenable alloy characterized in having a compact morphology of the gamma-double prime phase enveloping the gamma-prime phase consisting essentially of about 43 to 47% nickel, 8 to 12% chromium, 3 to 3.8% niobium, 0.3 to 0.4% silicon, 1.5 to 2% titanium, 0.2 to 0.3% aluminum, 0.02 to 0.05% carbon, 0.002 to 0.006% boron, and the balance essentially all iron.

6. An iron-nickel-chromium age-hardenable alloy characterized in having a compact morphology of the gamma-double prime phase enveloping the gamma-prime phase and consisting essentially of about 45% nickel, about 12% chromium, about 3.6% niobium, about 0.35% silicon, about 1.7% titanium, about 0.3% aluminum, about 0.03% carbon, about 0.005% boron and the remainder iron.

7. The alloy of claim 6 additionally containing about 0.2% manganese, about 0.01% magnesium, and about 0.05% zirconium.

* * * * *